US005201302A

United States Patent [19]

Furuya et al.

[11] Patent Number: 5,201,302

[45] Date of Patent: Apr. 13, 1993

[54] VOLTAGE REGULATOR TUBE FOR IGNITION SYSTEM OF INTERNAL COMBUSTION ENGINE

[75] Inventors: Tetsuo Furuya; Nobuto Tsujikawa, both of Fukuchiyama, Japan

[73] Assignee: West Electric Company, Ltd., Osaka, Japan

[21] Appl. No.: 888,904

[22] Filed: May 26, 1992

[30] Foreign Application Priority Data

May 27, 1991 [JP] Japan ..... 3-120986

[51] Int. Cl.[5] ..... F02P 15/00

[52] U.S. Cl. ..... 123/627; 313/124

[58] Field of Search ..... 123/620, 627, 653, 654, 123/169 MG; 313/124

[56] References Cited

U.S. PATENT DOCUMENTS

| | | | |
|---|---|---|---|
| 1,406,858 | 2/1922 | Henricks | 123/627 |
| 1,464,112 | 8/1923 | Reddig | 123/627 |
| 4,351,308 | 9/1982 | Halilovic et al. | 123/627 |
| 4,727,891 | 3/1988 | Schmidt et al. | 123/627 |
| 4,770,152 | 9/1988 | Mogi et al. | 123/627 |
| 5,080,083 | 1/1992 | Sato et al. | 123/627 |

FOREIGN PATENT DOCUMENTS 0094278 4/1990 Japan .

*Primary Examiner*—Willis R. Wolfe

*Attorney, Agent, or Firm*—Wenderoth, Lind & Ponack

[57] ABSTRACT

A voltage regulator tube for an ignition system of an internal combustion engine, comprising: a cylindrical enclosure made of electrical insulating material and formed with a hollow extending therethrough; a first metallic sealing member for sealing one opening of the hollow, which is electrically connected to a secondary winding of an ignition coil; a first main electrode mounted on the first metallic sealing member in the hollow; a second metallic sealing member for sealing the other opening of the hollow, which is electrically connected to a spark plug; and a second main electrode which is mounted on the second metallic sealing member in the hollow such that the first and second main electrodes confront each other; wherein inert gas is hermetically filled in the hollow; wherein the following equation is satisfied:

$$-1.5 \leqq 0.8L - 0.72R + 3.11H - 5.81 \leqq 1.5$$

where character L denotes a distance between distal ends of the first and second main electrodes in mm, character R denotes a diameter of the first metallic sealing member in mm and character H denotes a height of the first main electrode in mm.

2 Claims, 2 Drawing Sheets

VOLTAGE REGULATOR TUBE FOR IGNITION SYSTEM OF INTERNAL COMBUSTION ENGINE

BACKGROUND OF THE INVENTION

The present invention relates to a voltage regulator tube for an ignition system of an internal combustion engine, which is connected in series to a spark plug in the ignition system so as to be used.

An electric circuit of a known ignition system for an internal combustion engine is generally shown in FIG. 2. When a starter (not shown) is driven by closing a switch 10, a contact of a switch 12 is opened and closed by actuation of a cam (not shown) coupled with the starter. As a result, electric current flows through a primary winding of an ignition coil 11, so that a high voltage of several times ten KV is induced in a secondary winding of the ignition coil 11 and is supplied to a spark plug 14 through a distributor 13 and thus, sparks are generated between electrodes of the spark plug 14.

Meanwhile, such a phenomenon may happen in which the voltage required for spark discharge cannot be obtained due to carbon, lead compound, etc. adhering to surface of a porcelaneous member of the spark plug. In order to prevent such a phenomenon, it is known to provide a voltage regulator tube between the ignition coil and the spark plug. The assignee assigned by the present inventors proposed a voltage regulator tube of this kind in, for example, Japanese Patent Laid-Open Publication No. 2-94278 (1990).

In the voltage regulator tube of this prior art document, one of opposite openings of a hollow extending longitudinally through a cylindrical enclosure made of electrical insulating material is sealed, through sealing glass, by one metallic sealing member on which one main electrode is mounted. Likewise, the other opening of the hollow is sealed, through sealing glass, by the other metallic sealing member on which the other main electrode is mounted such that inert gas having a predetermined pressure is hermetically filled in the hollow. If this voltage regulator tube is connected between the spark plug and the secondary winding of the ignition coil in FIG. 2, adherence of carbon, lead compound, etc. to the surface of the porcelaneous member of the spark plug is lessened. However, the following problem still arises. Namely, when the voltage regulator tube is provided between the ignition coil and the spark plug, discharge starting voltage of the voltage regulator tube may drop or rarely rise under the influence of a grounding member disposed adjacent to the voltage regulator tube and thus, it becomes impossible to stably supply the predetermined high voltage to the spark plug.

SUMMARY OF THE INVENTION

Accordingly, an essential object of the present invention is to provide a voltage regulator tube for an ignition system of an internal combustion engine, by which a high voltage can be stably supplied to a spark plug without being influenced by a grounding member disposed adjacent to the voltage regulator tube.

Another important object of the present invention is to provide a voltage regulator tube for an ignition system of an internal combustion engine, in which difference between a discharge starting voltage of the voltage regulator tube at the time when the voltage regulator tube is not mounted in the ignition system and that at the time when the voltage regulator tube is mounted in the ignition system is controlled to a permissible range and distance between first and second main electrodes, diameter of a first metallic sealing member and height of the first main electrode can be easily set so as to minimize influence exerted by the grounding member.

In order to accomplish these objects of the present invention, a voltage regulator tube for an ignition system of an internal combustion engine in which a high voltage generated at a secondary winding of an ignition coil is applied to a spark plug such that spark discharge is effected by said spark plug, according to the present invention is inserted between the secondary winding and the spark plug and comprises: a cylindrical enclosure which is made of electrical insulating material and is formed with a hollow extending therethrough such that the hollow has opposite openings; a first metallic sealing member for sealing one of the openings of the hollow, which is electrically connected to the secondary winding; a first main electrode which is mounted on the first metallic sealing member so as to be disposed in the hollow of the enclosure; a second metallic sealing member for sealing the other of the openings of the hollow, which is electrically connected to the spark plug; and a second main electrode which is mounted on the second metallic sealing member so as to be disposed in the hollow of the enclosure such that the first and second main electrodes confront each other; wherein inert gas is hermetically filled in the hollow of the enclosure; wherein the following equation is satisfied:

$$-1.5 \leqq 0.8L - 0.72R + 3.11H - 5.81 \leqq 1.5$$

where character L denotes a distance between a distal end of the first main electrode and a distal end of the second main electrode in mm, character R denotes a diameter of the first metallic sealing member in mm and character H denotes a height of the first main electrode in mm.

BRIEF DESCRIPTION OF THE DRAWINGS

These objects and features of the present invention will become apparent from the following description taken in conjunction with the preferred embodiment thereof with reference to the accompanying drawings, in which.

DETAILED DESCRIPTION OF THE INVENTION

Figure 1:
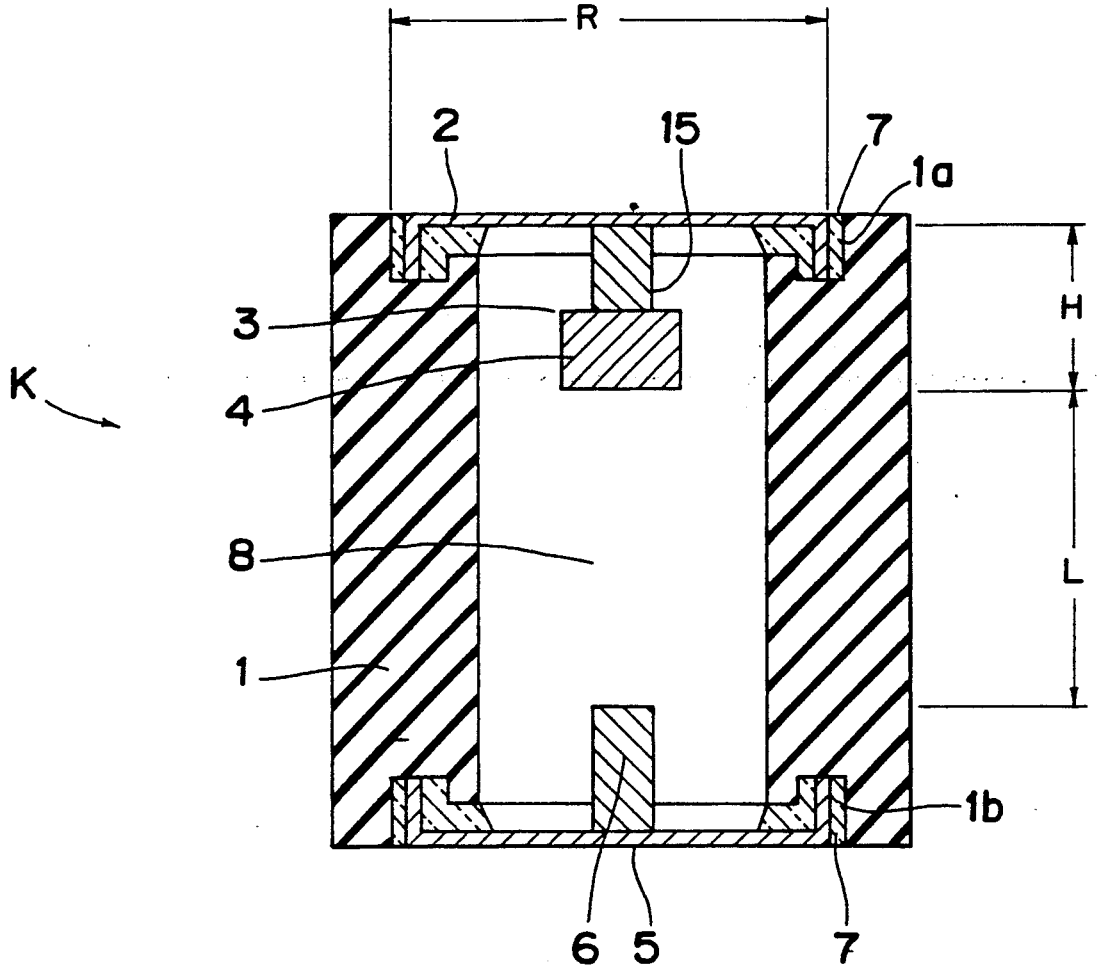
FIG. 1 is a sectional view of a voltage regulator tube for an ignition system of an internal combustion engine, according to one embodiment of the present invention.

FIG. 1 shows a voltage regulator tube K for an ignition system of an internal combustion engine, according to one embodiment of the present invention. The voltage regulator tube K includes a cylindrical enclosure 1 made of electrical insulating material such as ceramics. The enclosure 1 is formed with a hollow 8 extending longitudinally therethrough such that the hollow 8 has opposite openings on opposite end faces of the enclosure 1, respectively. The enclosure 1 is produced by sintering press molded ceramic powder or by cutting a ceramic cylinder. One of the openings of the hollow 8 is sealed by a first metallic sealing member 2 made of, for example, covar, while the other opening of the hollow 8 is sealed by a second metallic sealing member 5 made of the same material as the first metallic sealing member 2. A first main electrode 3 is provided in the hollow 8 and includes a metallic rod 15 and a sintered member 4 attached to one end of the metallic rod 15. The other end of the metallic rod 15 is fusion bonded to an inner face of the first metallic sealing member 2 such that the sintered member 4 is directed towards the second metallic sealing member 5. The sintered member 4 is formed by pressing and sintering one or a mixture of metallic powders of tungsten, tantalum, molybdenum, etc. A second main electrode 6 is provided in the hollow 8 and is formed by a rod made of one or an alloy of tungsten, tantalum, etc. The second main electrode 6 is fusion bonded to an inner face of the second metallic sealing member 5 so as to confront the sintered member 4 of the first main electrode 3.

In addition to the first and second metallic sealing members 2 and 5, each opening of the hollow 8 is sealed by sealing glass 7. For forming the sealing glass 7, glass frit having a coefficient of thermal expansion similar to that of the enclosure 1 is initially applied to annular grooves 1*a* and 1*b* formed on the opposite end faces of the enclosure 1, respectively and is preliminarily heated and fusion bonded to the grooves 1*a* and 1*b*. Then, in a state in which the first and second metallic sealing members 2 and 5 are, respectively, mounted on the grooves 1*a* and 2*b*, the glass frit is again fused and thus, the first and second metallic sealing members 2 and 5 are attached to the opposite end faces of the enclosure 1, respectively as shown in FIG. 1 so as to seal the openings of the hollow 8 through the sealing glass 7. Meanwhile, inert gas having a predetermined pressure is hermetically filled in the hollow 8.

Figure 2:
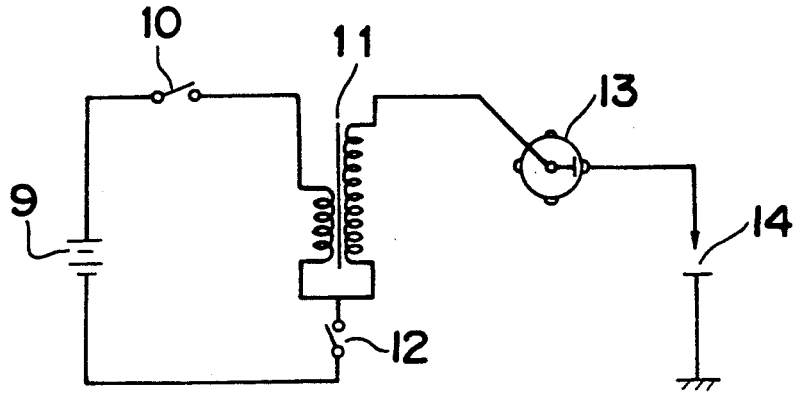
Fig. 2 PRIOR ART
FIG. 2 is a circuit diagram of a prior art ignition system of an internal combustion engine (already referred to)
Figure 3:
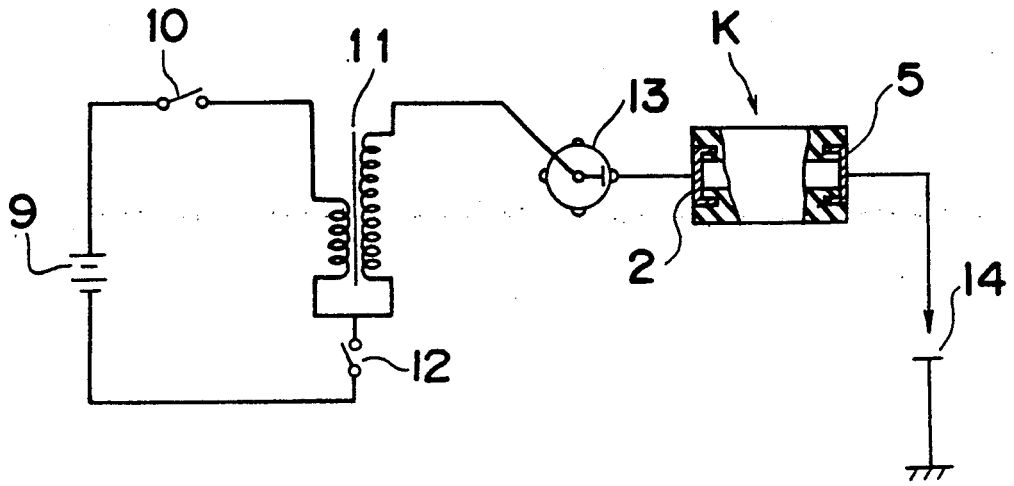
FIG. 3 is a partly sectional view showing the voltage regulator tube of FIG. 1 mounted in an ignition system of an internal combustion engine.
Figure 4:
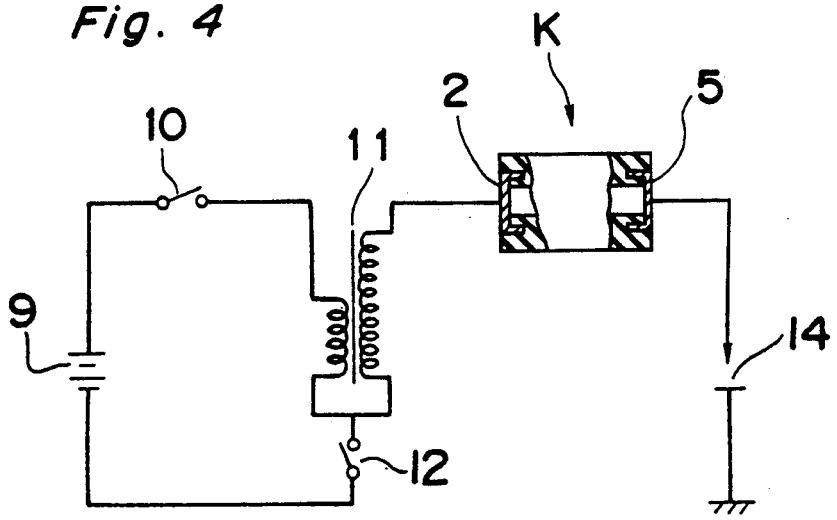
FIG. 4 is a view similar to FIG. 3, particularly showing a modification thereof.

When the voltage regulator tube K of the above described arrangement is mounted in an ignition system (FIG. 2) of an internal combustion engine, the voltage regulator tube K is electrically connected between an ignition coil 11 and a spark plug 14 such that the first and second metallic sealing members 2 and 5 confront a secondary winding of the ignition coil 11 and the spark plug 14, respectively as shown in either FIG. 3 or FIG. 4.

Supposing that character R denotes a diameter of the first metallic sealing member 2 in mm, character L denotes a distance between a distal end of the first main electrode 3 and a distal end of the second main electrode 6 in mm and character H denotes a height of the first main electrode 3 in mm, degree of influence exerted by a grounding member disposed adjacent to the voltage regulator tube K, i.e. changes of discharge starting voltage at the time when the voltage regulator tube K is mounted in the ignition coil of FIG. 2 are measured and results of the measurement are obtained as shown in Table 1 below. In the measurement, five voltage regulator tubes K are prepared for each of measurement Nos. 1–12 by fixing pressure of inert gas filled in the hollow 8 and by changing the dimensions R, L and H, while voltage characteristics generated at the secondary winding of the ignition coil 11 are set at identical conditions. In Table 1, characters V1 denote a discharge starting voltage at the time when the voltage regulator tube K is not mounted in the ignition system of FIG. 2, while character V2 denotes a discharge starting voltage at the time when the voltage regulator tube K is mounted in the ignition system of FIG. 2.

TABLE 1

| No. | L (mm) | R (mm) | H (mm) | V1-V2 (KV) Range | V1-V2 (KV) Average |
|---|---|---|---|---|---|
| 1 | 3.0 | 9.0 | 3.5 | 0.7–1.4 | 1.0 |
| 2 | 3.0 | 9.0 | 2.5 | −1.5–−3.6 | −2.1 |
| 3 | 3.0 | 10.0 | 3.5 | −0.3–0.6 | 0.3 |
| 4 | 3.0 | 10.0 | 2.5 | −1.8–−4.0 | −2.8 |
| 5 | 3.0 | 11.5 | 3.5 | −1.3–−0.2 | −0.8 |
| 6 | 3.0 | 11.5 | 2.5 | 2.4–4.9 | 3.9 |
| 7 | 4.5 | 9.0 | 3.5 | 1.5–3.3 | 2.2 |
| 8 | 4.5 | 9.0 | 4.5 | 3.5–7.4 | 5.3 |
| 9 | 4.5 | 10.0 | 3.5 | 1.1–2.1 | 1.5 |
| 10 | 4.5 | 10.0 | 4.5 | 2.9–6.1 | 4.6 |
| 11 | 4.5 | 11.5 | 3.5 | −0.1–0.8 | 0.4 |
| 12 | 4.5 | 11.5 | 4.5 | 2.5–4.4 | 3.5 |

It is needless to say that difference between the discharge starting voltages V1 and V2, i.e. (V1−V2) be zero for the voltage regulator tube. However, since a discharge starting voltage of 20 KV is required for the voltage regulator tube for improving influence of carbon, lead compound, etc., difference between the discharge starting voltages V1 and V2 falling in a range of +1.5 KV is not particularly problematical for practical use. The measurement Nos. 1, 3, 5, 9 and 11 satisfy this permissible voltage range on the average. However, in view of scatter of respective values of (V1−V2), the measurement Nos. 1, 3, 5 and 11 in which the respective values of (V1−V2) fall in the range of +1.5 KV should be selected as data of the dimensions L, R and H. From such data, relation between the value of (V1−V2) of +1.5 KV and the dimensions L, R and H is expressed by the following equation (1).

$$-1.5 \leqq 0.8L - 0.72R + 3.11H - 5.81 \leqq 1.5 \quad (1)$$

As described above, in the voltage regulator tube for the ignition system of the internal combustion engine, according to the present invention, since the diameter of the first metallic sealing member, the height of the first main electrode and the distance between the first and second main electrodes are set so as to satisfy the above equation, the difference between the discharge starting voltage at the time when the voltage regulator tube is not mounted in the ignition system and the dishcarge starting voltage at the time when the voltage regulator tube is mounted in the ignition system can be set to the permissible range of +1.5 KV and thus, influence exerted by the grounding member can be minimized.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A voltage regulator tube for an ignition system of an internal combustion engine in which a high voltage generated at a secondary winding of an ignition coil is applied to a spark plug such that spark discharge is effected by said spark plug, said voltage regulator tube being inserted between said secondary winding and said spark plug and comprising:

a cylindrical enclosure which is made of electrical insulating material and is formed with a hollow extending therethrough such that the hollow has opposite openings;

a first metallic sealing member for sealing one of the openings of the hollow, which is electrically connected to said secondary winding;

a first main electrode which is mounted on said first metallic sealing member so as to be disposed in the hollow of said enclosure;

a second metallic sealing member for sealing the other of the openings of the hollow, which is electrically connected to said spark plug; and a second main electrode which is mounted on said second metallic sealing member so as to be disposed in the hollow of said enclosure such that said first and second main electrodes confront each other;

wherein inert gas is hermetically filled in the hollow of said enclosure;

wherein the following equation is satisfied:

$$-1.5 \leqq 0.8L - 0.72R + 3.11H - 5.81 \leqq 1.5$$

where character L denotes a distance between a distal end of said first main electrode and a distal end of said second main electrode in mm, character R denotes a diameter of said first metallic sealing member in mm and character H denotes a height of said first main electrode in mm.

2. A voltage regulator tube as claimed in claim 1, where said enclosure is made of ceramics.

* * * * *